United States Patent [19]

Levey

[11] Patent Number: 4,569,480

[45] Date of Patent: Feb. 11, 1986

[54] SURGE CONTROLLED AIR-HYDRAULIC MATERIAL SPRAYER

[75] Inventor: Gustave S. Levey, Houston, Tex.

[73] Assignee: Speeflo Manufacturing Corporation, Houston, Tex.

[21] Appl. No.: 637,195

[22] Filed: Aug. 3, 1984

[51] Int. Cl.[4] ..... B05B 1/24

[52] U.S. Cl. ..... 239/135; 137/334; 239/127; 239/129; 417/390

[58] Field of Search ..... 239/124, 127, 128, 129, 239/135, 139; 417/390, 403; 137/334, 885, 596.15

[56] References Cited

U.S. PATENT DOCUMENTS

| | | | |
|---|---|---|---|
| 2,687,739 | 8/1954 | Shelburne et al. | 239/127 X |
| 2,779,291 | 1/1957 | Albright | 417/390 X |
| 2,779,627 | 1/1957 | Gray | 299/86 |
| 2,870,717 | 1/1959 | Dube et al. | 417/390 |
| 3,018,968 | 1/1962 | Levey | 239/127 X |
| 3,403,695 | 10/1968 | Hopkins | 239/112 X |

FOREIGN PATENT DOCUMENTS

| | | | |
|---|---|---|---|
| 2014653 | 8/1979 | United Kingdom | 417/390 |

*Primary Examiner*—Jeffrey V. Nase
*Assistant Examiner*—Daniel R. Edelbrock
*Attorney, Agent, or Firm*—Fulbright & Jaworski

[57] ABSTRACT

A spray gun includes a material inlet and an air inlet. A reciprocating hydraulic motor is connected to and drives a reciprocating hydraulic pump which pumps material from a material reservoir to the pump outlet. A first air piloted hydraulic valve is connected to the pump outlet and the first valve is connected to and is operable to transmit pumped material to either the material inlet of the gun or to the material reservoir. A second motor is connected to and drives a second hydraulic pump which is connected to and supplies hydraulic fluid from a hydraulic reservoir to the reciprocating hydraulic motor. A second air-piloted hydraulic valve is connected between the second hydraulic pump and reciprocating hydraulic motor and is operable to transmit pumped hydraulic fluid to either the reciprocating hydraulic motor or to the hydraulic fluid reservoir. An air control valve is connected to an air supply and is connected to the first and second valves. The control valve is connected to the air inlet of the sprayer and is adapted to actuate the first and second valves to the open position when the spray gun is actuated and is adapted to move the first and second valves to the vent position when the spray gun is deactuated thereby preventing a pressure surge buildup at the material inlet of the spray gun.

4 Claims, 2 Drawing Figures

SURGE CONTROLLED AIR-HYDRAULIC MATERIAL SPRAYER

BACKGROUND OF THE INVENTION

The use of air motor control systems for actuating material sprayers which use a surge control system to prevent buildup of pressure in the material delivery line is shown in U.S. Pat. No. 2,779,627. However, air systems are expensive as they require an expensive high volume air compressor and such systems are not energy efficient.

The present invention is directed to the use of hydraulic driven pumps for actuating a material sprayer in which an air control system is used to control the surges in the hydraulic power system to provide a more energy efficient system and one which is less expensive and only requires a small air compressor.

The present invention is also directed to transferring the unwanted heat in a hydraulic system actuvating a material sprayer to the material to be sprayed to decrease its viscosity.

SUMMARY

One feature of the present invention is directed to a surge controlled air-hydraulic material sprayer including a material sprayer having a material inlet and an air inlet. A reciprocating hydraulic motor is connected to and drives a reciprocating hydraulic pump to pump material from a material reservoir to a pump outlet. A first air pilot controlled hydraulic valve is connected to the pump outlet and the first valve is connected to and is operable to transmit pumped material to either the material inlet of the sprayer or to the material reservoir. A second motor is connected to and drives a second hydraulic pump which is connected to and supplies hydraulic fluid from a hydraulic reservoir to the reciprocating hydraulic motor. A second air piloted hydraulic valve is connected between the second hydraulic pump and the reciprocating hydraulic motor and is operable to pump hydraulic fluid to either the reciprocating hydraulic motor or to the hydraulic fluid reservoir. An air control valve is connected to an air supply and is connected to the first and second air piloted hydraulic valves. The air control valve is connected to the air inlet of the sprayer and is adapted to actuate the first and second valves to the open position when the sprayer is actuated and is adapted to move the first and second valves to the vent position when the sprayer is deactuated thereby preventing a pressure surge buildup at the material inlet of the sprayer.

Still a further object of the present invention is wherein the first and second valves are three-way valves spring biased to the vent position and air piloted actuated to the open position.

Yet a further object is the provision of a heat transfer system which extracts the undesired heat from a hydraulic system which activates a material sprayer and transfers the heat to the material to be sprayed thereby decreasing the viscosity of the material making it easier to spray particularly in a cold environment.

Other and further objects, features and advantages will be apparent from the following description of a presently preferred embodiment of the invention, given for the purpose of disclosure, and taken in conjunction with the accompanying drawings.

DESCRIPTION OF THE PREFERRED EMBODIMENT

Figure 1:
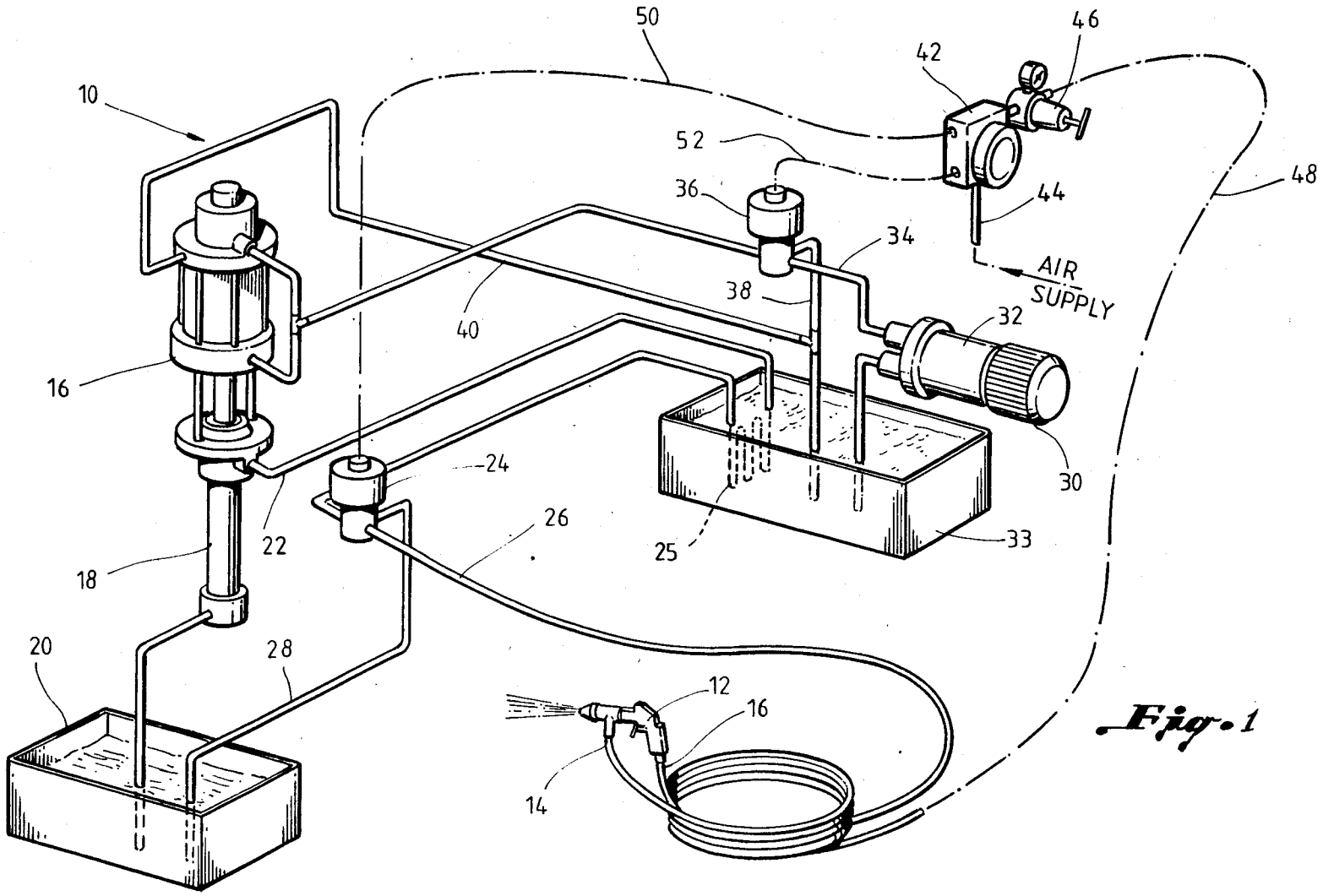
FIG. 1 is an elevational, perspective view of the apparatus in the present invention.
Figure 2:
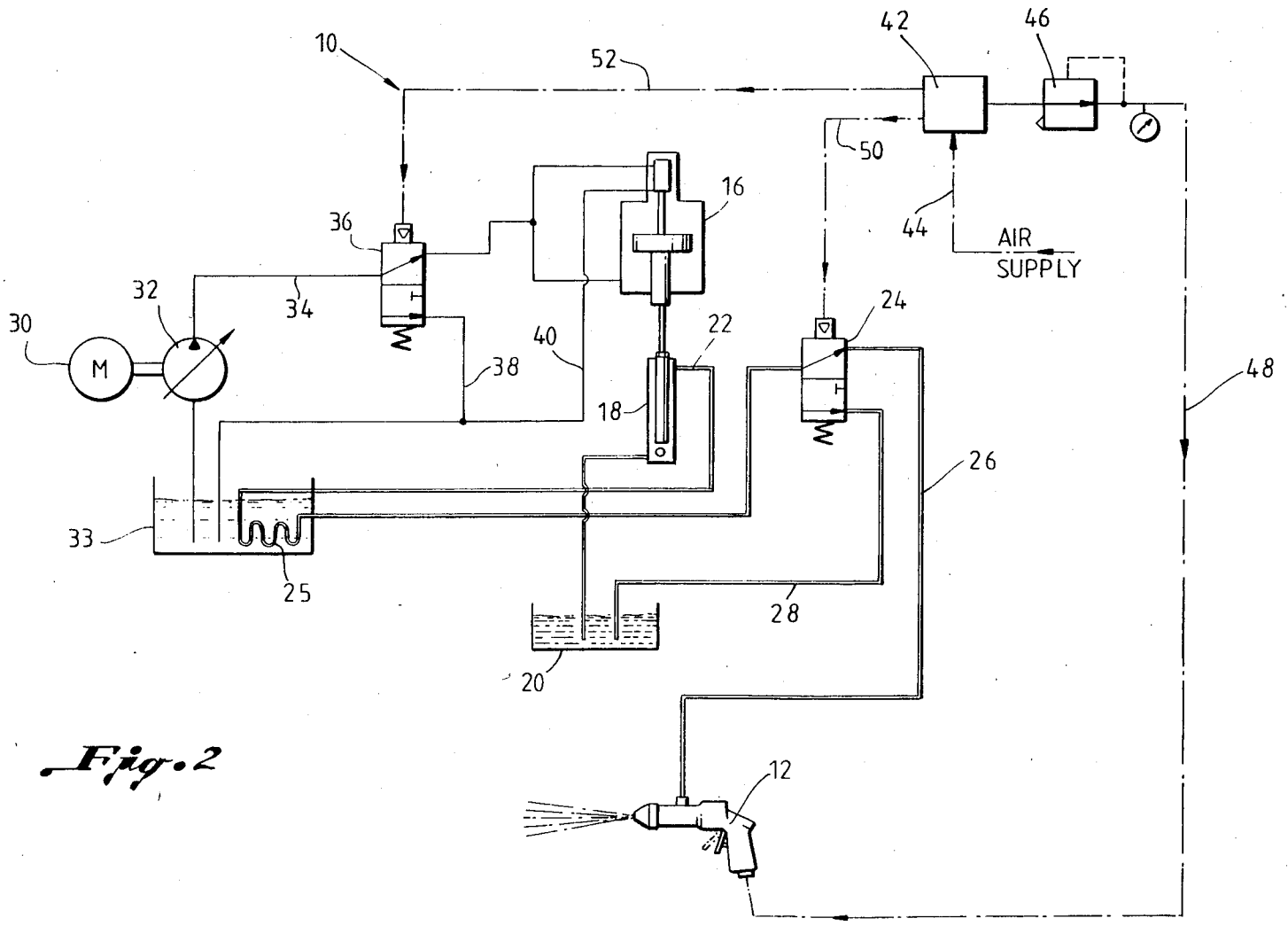
FIG. 2 is a schematic view of the present invention shown in the spraying position.

Referring now to FIGS. 1 and 2, the reference numeral 10 generally indicates the surge controlled air-hydraulic material sprayer system of the present invention and includes a material sprayer or spray gun 12 having a material inlet 14 and an air inlet 16. The spray gun 12 is adapted to spray various types of viscous materials such as cut-back asphaltum or other heavy and often fibrated products.

A conventional hydraulic reciprocating motor 16, such as Model No. 441-560, sold by Speedflo Manufacturing Corporation, is connected to and drives a conventional reciprocating pump 18, such as Model No. 314,559, sold by Speedflo Manufacturing Corporation. The pump 18 is adapted to pump material to be sprayed from a material reservoir 20 to a pump outlet 22.

For reasons more fully discussed hereinafter, a first air piloted spring biased, three-way valve 24 has its inlet connected to the pump outlet 22 and is connected to and is operable to transmit pumped material to a line 26 to the material inlet 14 of the spray gun 12 or in the alternative to a vent line 28 to the material reservoir 20.

A second motor 30 drives a second conventional hydraulic pump 32 such as a hydraulic constant pressure variable volume multiple piston pump which is connected to and supplies hydraulic fluid from a hydraulic reservoir 33 to a line 34 to operate the reciprocating hydraulic motor 16.

As will be more fully described hereinafter, a second air piloted, spring biased, three-way hydraulic valve 36 is connected between the second hydraulic pump 32 and the line 34 and the reciprocating hydraulic motor 16 and is operable to transmit pumped hydraulic fluid to either the reciprocating hydraulic motor 16 or to a vent line 38 leading to the hydraulic oil reservoir 33. In addition, a low pressure line 40 is provided for venting hydraulic fluid from the motor 16 to the vent line 38 and reservoir 33.

The fluid pressure at the outlet of the spray gun 12 is the pressure at the outlet 22 of the pump 18 less the frictional losses through the line 26. For example, assuming that the fluid pressure at the outlet of the spray gun 12 is a desired 200 pound per square inch for spraying materials such as cutback asphaltum at the rate of 1 to 4 gallons per minute, and assuming that the line 26 is 150 feet long and has a 800 pound pressure drop the hydraulic power circuit is selected to provide an output of 1000 psi (200 plus 800 psi) at the outlet 22 of the pump 18. However, in the absence of the material dumping hydraulic valve 24 and the hydraulic dumping valve 36, the fluid pressure at the outlet of the spray gun 12 would rise to 1000 psi when spraying is stopped as the fluid pressure would equalize throughout the line 6. Therefore, upon the next actuation of the spray gun 12, the 1000 psi fluid pressure at the spray gun 12 would produce a surge of material many times greater than the work requires and excess material would be sprayed from the gun 12 until the delivery volume reaches the normal flow and concurrently the fluid pressure at the spray gun 12 has been reduced by frictional losses in the line 26 to the desired psi.

Therefore, a control valve 42 such as Model No. 950-556 sold by Speedflo Manufacturing Corporation and described in U.S. Pat. No. 2,779,627, which is a diaphragm actuated valve for seating on one of two seats, is provided. The control valve 42 is connected to an air supply 44 and through a pressure regulator 46 applies regulated air through air hose 48 to the air inlet 16 of the spray gun 12. Actuation of the spray gun 12, upon passage of atomizing air from the gun 12 creates a small air pressure drop at the air control valve 42. This creates an air pressure differential to move a diaphragm in the valve 42 to open the valve 42 to release supply air to the air lines 50 and 52 which lead to the air pilots on the valves 24 and 36, respectively, for maintaining the valves 24 and 36 in the open position as best seen in FIG. 2. In this mode of operation, coating material or the like is syphoned by the pump 18, pumped through the valve 24 and the line 26 to the spray gun 12.

When the trigger of the spray gun 12 is deactuated, an increase of pressure, such as 5 to 15 pounds of air is created at the control valve 42 to actuate valve 42 to vent air from the lines 50 and 52 and from the air pilots of the valves 24 and 36, respectively. Thus, hydraulic valve 36 is actuated to move to the vent position and dump hydraulic oil from the line 34 to the vent line 38 and back to the hydraulic oil reservoir 33 thus stopping the motor 16 and pump 18. Similarly, the actuation of the hydraulic valve 24 moves the valve 24 to the vent position which dumps the material at the outlet 22 and the line 26 to the material reservoir 20 to reduce the pressure in the line 26. Thus, the actuation of the valves 24 and 36 precludes a buildup and/or retention of fluid pressure in the line 26 during non-spraying periods with the result that the surge created by the normal pressure buildup is avoided.

Therefore, the present invention provides a material spraying system using hydraulic power with only a small air compressor thereby providing an energy saving system, without requiring an expensive high volume air compressor to drive air motors, and with an air-hydraulic control system for avoiding undesired pressure surges.

Another feature of the present invention is the provision of transferring the unwanted and undesired heat in a hydraulic system which activates a material sprayer to the material to be sprayed which decreases its viscosity, thereby allowing the material to be more easily sprayed, and to be sprayed in a cold environment. Referring now to the drawings, a heat exchange coil 25 is inserted in the hydraulic oil reservoir 34 for picking up the waste and undesired heat generated by the hydraulic pump 32 and hydraulic motor 16. The coil 25 is connected between the outlet 22 of the material pump 18 and the inlet to the three-way valve 24. Thus, the material to be sprayed, which may be extremely viscous, is pumped from the outlet 22 through the coil 25 and back to the three-way valve 24. This feature is particularly advantageous in spraying viscous materials. That is some types of materials which are sprayed such as cut-back asphaltum cannot be sprayed under 40 degrees fahrenheit and preferably not under 50 degrees fahrenheit temperatures. By pumping the material through the heat exchange coil 25, the undesired heat in the hydraulic system is utilized to heat the material to be sprayed which increases its viscosity and allows the system then to be used under colder environmental conditions. While the feature of transferring the unwanted heat in the hydraulic system to the material to be sprayed is particularly useful in the system 10, it may also be used in airless systems. That is, the valves, 42, 24, 36 and the lines 48, 50, 52 and 44 may be omitted to provide an airless system in which the hydraulic system merely pumps the sprayed material to the spray gun through the coil 25.

The present invention, therefore, is well adapted to carry out the objects and attain the ends and advantages mentioned as well as others inherent therein. While a presently preferred embodiment of the invention is given for the purpose of disclosure, numerous changes in the details of construction and arrangement of parts will readily suggest themselves to those skilled in the art and which are encompassed within the spirit of the invention and the scope of the appended claims.

What is claimed is:

1. A surge controlled air-hydraulic material sprayer comprising, a material sprayer having a material inlet and an air inlet, a reciprocating hydraulic motor connected to and driving a reciprocating hydraulic pump, said pump adapted to pump material from a material reservoir to a pump outlet, a first air piloted hydraulic valve connected to the outlet, said first valve connected to and operable to transmit pumped material to either the material inlet of the sprayer or to the material reservoir, a second motor connected to and driving a second hydraulic pump which is connected to and supplies hydraulic fluid from a hydraulic reservoir to said reciprocating hydraulic motor, a second air piloted hydraulic valve connected between the second hydraulic pump and the reciprocating hydraulic motor and operable to transmit pumped hydraulic fluid to either the reciprocating hydraulic motor or to the hydraulic fluid reservoir, and an air control valve connected to an air supply and connected to the first and second air piloted hydraulic valves, said air control valve connected to the air inlet of the sprayer and adapted to actuate the first and second valves to the open position when the sprayer is actuated and adapted to move the first and second valves to the vent position when the sprayer is deactuated thereby preventing a pressure surge buildup at the material inlet of the sprayer.

2. The apparatus of claim 1 wherein the first and second valves are three way valves spring biased to the open position and air piloted actuated to the vent position.

3. The apparatus of claim 1 including a heat exchanger positioned in the hydraulic fluid reservoir and connected between the output of the reciprocating hydraulic pump and inlet of the first valve whereby heat from the hydraulic reservoir is transmitted to the material to be sprayed.

4. A material sprayer comprising, a material sprayer having a material inlet, a reciprocating hydraulic motor connected to and driving a reciprocating hydraulic pump, said pump connected to and adapted to pump material from a material reservoir to the outlet of said pump, a second motor connected to and driving a second hydraulic pump which is connected to and supplies hydraulic fluid from a hydraulic reservior to said reciprocating hydraulic motor, and a heat exchanger positioned in the hydraulic reservior, said heat exchanger conducting material to be sprayed and connected to the outlet of the reciprocating hydraulic pump and to the inlet of the material sprayer for transferring the heat in the hydraulic reservoir to the material to be sprayed.

* * * * *